United States Patent [19]

Schneider et al.

[11] Patent Number: 5,000,437

[45] Date of Patent: Mar. 19, 1991

[54] INK REJECTING PADDLE WHEEL DISTRIBUTOR

[75] Inventors: Eckhard Schneider, Stadtbergen; Hans Schwöpfinger, Augsburg, both of Fed. Rep. of Germany

[73] Assignee: Man Roland Druckmaschinen AG, Offenbach am Main, Fed. Rep. of Germany

[21] Appl. No.: 385,204

[22] Filed: Jul. 25, 1989

[30] Foreign Application Priority Data

Aug. 3, 1988 [DE] Fed. Rep. of Germany ..... 3826348

[51] Int. Cl.[5] ..... B65H 29/00; B41F 21/00

[52] U.S. Cl. ..... 271/187; 271/315; 101/420; 524/424

[58] Field of Search ..... 271/187, 315; 101/420, 101/421; 524/424

[56] References Cited

U.S. PATENT DOCUMENTS

| | | | |
|---|---|---|---|
| 4,395,512 | 7/1983 | Kubota et al. | 524/424 |
| 4,434,979 | 3/1984 | Köbler et al. | 271/187 |
| 4,454,283 | 6/1984 | Street et al. | 524/424 |
| 4,615,518 | 10/1986 | Di Blasio | 271/121 |
| 4,694,750 | 9/1987 | Greene | 101/420 |
| 4,846,062 | 7/1989 | Difflipp et al. | 101/420 |

FOREIGN PATENT DOCUMENTS

| | | | |
|---|---|---|---|
| 1213859 | 4/1966 | Fed. Rep. of Germany . | |
| 2240397 | 2/1974 | Fed. Rep. of Germany . | |
| 2168686 | 6/1986 | United Kingdom | 271/187 |

OTHER PUBLICATIONS

"Atlas des Zeitungs-und Illustrationsdruckes", (Atlas of Newspaper and Magazine Printing, by A. Braun, Frankfurt 1960, FIG. 91 on p. 76.

*Primary Examiner*—Robert P. Olszewski
*Assistant Examiner*—Steve Reiss
*Attorney, Agent, or Firm*—Frishauf, Holtz, Goodman & Woodward

[57] ABSTRACT

To prevent deposition of ink, and accumulation of ink deposits on the paddles or vanes (8) of a paddle wheel distributor (2), the paddles or vanes are made of a plastic material which has a surface which rejects ink, and prevents accumulation thereon; a suitable material is polyamide, preferably reinforced with fiber or filamentary material, such as carbon fibers, the polyamide of the type polyamide 6.6 being present in about 70% with 30% carbon fibers. This permits making the vanes with a part-spherical or part-circular, or elliptical cross section to provide rounded corners and hence gentle handling of printed products (7) collected in the pockets between adjacent vanes. Braking tongues (9) located between axially staggered rings (4) of vanes can be of the same material and are so positioned that, in a plane transverse to the printed folded products, such as newspapers being inserted into the pockets between the vanes, are deformed in a gentle or slightly undulating shape.

15 Claims, 2 Drawing Sheets

FIG. 1
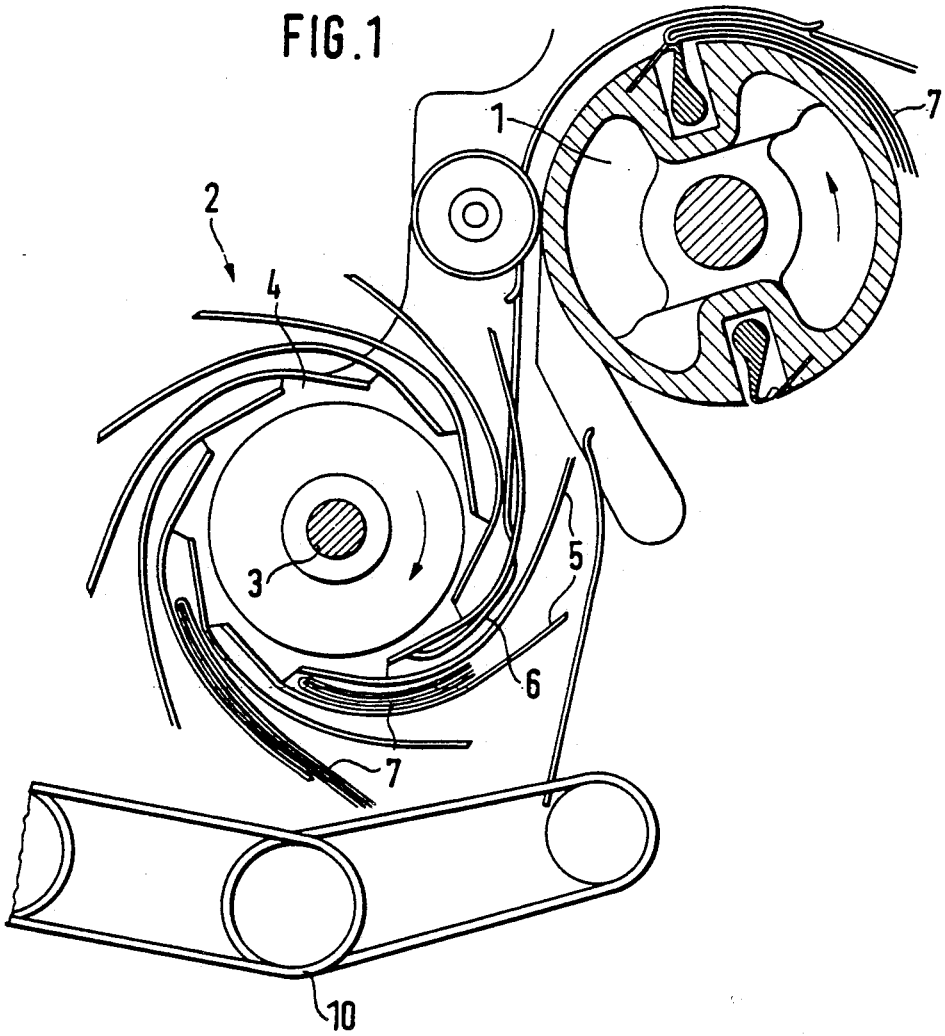
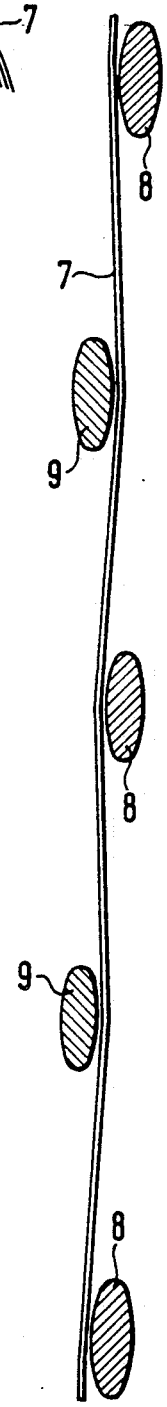
FIG. 4

8
B
D
8
11
11
12

INK REJECTING PADDLE WHEEL DISTRIBUTOR

REFERENCE TO RELATED PUBLICATION

"Atlas des Zeitungs- und Illustrationsdruckes" ("Atlas of Newspaper and Magazine Printing") by A. Braun, Frankfurt 1960, FIG. 91 on page 76.

The present invention relates to a paddle wheel distributor for printed products, and more particularly for folded printed products, such as newspapers and the like, delivered from a rotary printing machine.

BACKGROUND

Various types of paddle wheel distributors are known and the referenced publication "Atlas des Zeitungs- und Illustrationsdruckes" ("Atlas of Newspaper and Magazine Printing") by A. Braun, Frankfurt 1960, FIG. 91 on Page 76, illustrates a typical newspaper paddle wheel distributor having paddles or vanes made of flat strip material, such as steel, of essentially rectangular cross section. As printing machine speeds, and hence delivery speeds increase, it has been found that the metallic surfaces of the vanes or paddles of the paddle wheel distributor have the tendency to accept ink from the printed products. In case of malfunction, for example upon uncontrolled placement of too many folded products in a paddle pocket, formed by adjacent paddle wheels, it may also occur that the metallic vanes or paddles are bent. Shut-down of the production line is then required until the vanes can be straightened or replaced. Since the paddle wheel distributor is usually part of an integral distribution network, shut-down of the paddle wheel distributor, if only one paddle wheel is bent, causes a substantial loss of production capacity. Typically, the paddle distributor is included in a chain of paper handling apparatus which has folding apparatus, formers and the like, all of which then have to be shut down.

THE INVENTION

It is an object to improve paper handling and more particularly handling of folded paper products derived from a printing machine which includes a paddle wheel distributor, by improving the paddle wheel distributor so that the printed products are handled more gently thereby than heretofore, and in which the paddles are not subject to bending or deformation, even upon malfunction or plugging of distribution pockets of the paddle wheel distributor.

In accordance with the invention, it has been found, surprisingly, that by replacing the metallic vanes of prior art paddle wheel distributors with vanes or paddles which are made of a plastic material, malfunction can be largely prevented. The plastic material should have the characteristic that its surface rejects ink or ink accumulation, even if the ink on the distributed folded paper products is not entirely dry. Yet, due to the surface characteristics of ink-rejecting plastics, no ink will accumulate on the paddles which might cause a change in surface condition which may interfere with proper paper handling in the pockets formed by adjacent paddles or vanes.

In accordance with a preferred feature of the invention, the paddles or vanes are made of fiber or filament reinforced polyamide resin, preferably carbon fiber reinforced; such vanes have a particularly high stability while exhibiting high elasticity and a surface which is highly rejecting of ink.

Forming the vanes as plastic structures has the additional advantage that the vanes can be shaped for maximum efficiency of handling of printed products. In metallic vanes, rounding the edges introduces costly machining operations; a preferred shape for the vanes is not strictly rectangular but slightly bulged in the center, for example with somewhat elliptical or slightly spherical cross section. This is very difficult to make of metal, but plastic vanes, for example made by injection molding, can be readily shaped for maximum efficiency in paper handling. Thus, the shape of the article can be dictated primarily by its ultimate use, rather than by manufacturing considerations. Vanes or paddles with part-circular or part-spherical or elliptical cross section are particularly desirable since they provide excellent rejection of ink deposits. This is particularly if the vanes have to cooperate with fixed braking tongues. Such braking tongues can be so placed that folded products which are injected or dropped between pockets formed by adjacent vanes are braked by contact with the braking tongues. These braking tongues can be fixed and, in accordance with a feature of the invention, are so located with respect to the paddles that the printed products are slightly deformed in an undulating pattern. These braking tongues can be made of the same material as the vanes and paddles, so that the overall structure, paddle wheel distributor and braking tongues as accessories, will all have ink-rejecting characteristics, so that the printed products will encounter only smooth plastic surfaces.

DRAWINGS

FIG. 1 is a highly schematic side view of a paddle wheel distributor receiving printed products from a folding lap cylinder;

FIG. 4 is a cross-sectional view through vanes and braking tongues taken in a plane perpendicular to a printed product being introduced into the paddle wheel distributor.

DETAILED DESCRIPTION

Figures 2, 3:
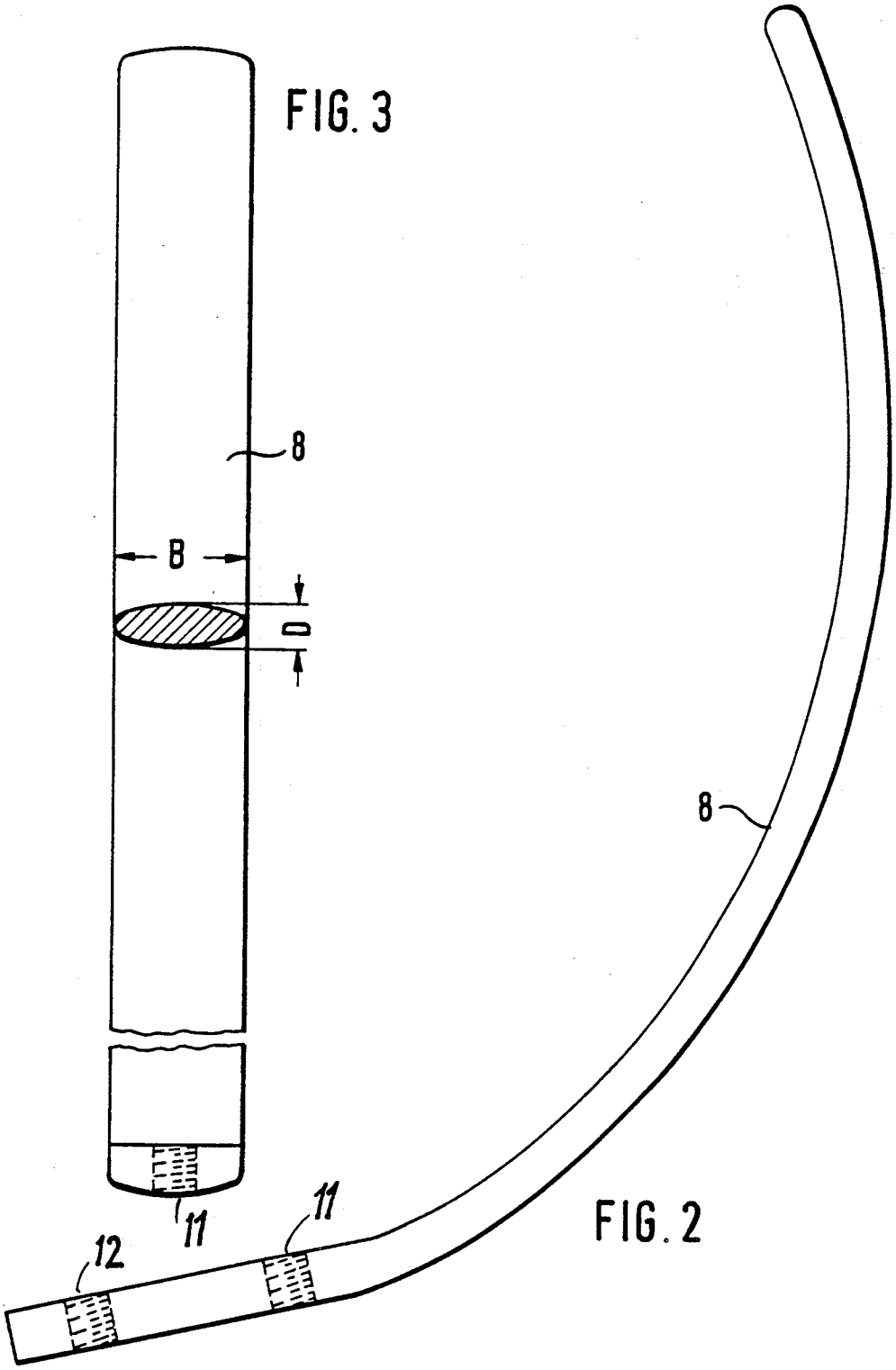
FIG. 2 is a side view of a vane in accordance with the present invention.
FIG. 3 is a cross-sectional view of a vane, illustrating a preferred shape.

FIG. 1 is a highly schematic fragmentary view of a paper handling section of a printing machine, and more particularly of a folding apparatus and distributor. A folding flap cylinder 1 receives and folds printed products 7 for delivery to a paddle wheel distributor 2. The paddle wheel distributor 2 is formed by a shaft 3 on which, axially staggered with gaps therebetween, a plurality of paddle rings 4 are located, each one containing a plurality of circumferentially uniformly distributed paddles or distribution vanes 5.

The spaces between adjacent vanes 5 form pockets for reception of the printed products.

The rings 4 are axially staggered on the shaft 3. Between the rings 4, and at the right half of the paddle wheel distributor 2, braking tongues 6 are located, having an outer contour which, in projection, partially narrows the pockets formed by adjacent or sequential vanes 5. The braking tongues 6 are secured to the printing machine in a suitable manner, as well known. The braking tongues, by sequentially narrowing the pocket, brake folded products 7 as they are injected or delivered or dropped by gravity into the pockets between adjacent vanes. The folded products, after being separated in the paddle wheel distributor, are then deposited in imbricated or shingled position on a transport belt system 10.

The paddle wheel distributor just described is similar to well known structures.

In accordance with the present invention, the paddles 5 are made of a plastic material which has a surface which prevents deposition of ink thereon. This is in contrast to prior art structures in which the vanes 5 were made of metal having an approximately rectangular cross section. In accordance with the present invention, the vanes 8 are, preferably, made of polyamide with fiber or filamentary reinforcement, preferably carbon fiber reinforcement. A proportion of about 70% polyamide 6.6 resin to 30% carbon fiber has been found to be particularly suitable.

In accordance with a feature of the invention, the cross section of the vanes 8 is rounded. A depressed, part-spherical or elliptical cross section is preferred. FIG. 3 illustrates an elliptical cross section of a vane 8, in which the relationship of width B of the vane to the thickness D is in the order of about 3:1 to 4:1; this is a preferred range.

The plastic material vanes can be made easily and inexpensively in injection molding processes, entirely independently of the cross-sectional shape which is desired. Rounding of the edges and particular shapes of the vanes are thus obtained merely by suitable shaping of the mold, in the very same manufacturing process during which the vanes are made; additional finishing steps are not necessary. It is also readily possible to change the dimensions of the vane over the length thereof, for example by changing the thickness or the width which, in metallic vanes, requires laborious machining.

The shapes of the vanes and attachment holes 11, 12 formed therein are determined by the basic construction of the paddle wheel distributor 2.

The vanes 8 on the paddle wheel distributor 2, in accordance with the present invention, are particularly suitable for cooperating with fixed braking tongues 9, located in the axial spaces between the rings 4 of the vanes. The braking tongues 9 are preferably so located with respect to the vanes 8, as best seen in FIG. 4, that a folded product 7 introduced in the pockets between the vanes is slightly deflected into a gently undulating shape. FIG. 4 illustrates a printed folded product 7 in a plane perpendicular to the folded product 7 being introduced in a pocket between adjacent vanes. The braking tongues 9 are offset or out-of-line with respect to the vanes 8 to thereby cause the slightly undulating deflection of the printed product. This slight deflection results in gently braking of the incoming folded products. Deposition of ink or creasing or seven scoring of incoming printed products, which at times occurs with metallic vanes of flat metal stock is effectively avoided.

The braking tongues 9, suitably, are made of the same material as the vanes 8 and, preferably, have the same cross-sectional shape and dimension.

Various changes and modifications may be made within the scope of the inventive concept.

We claim:

1. Paddle wheel distributor for receiving folded printed products (7) from a printing machine and delivering said products to a transport means (10), said paddle wheel distributor comprising a paddle wheel structure (2) having a shaft (3) and a plurality of paddles or vanes (8) secured to the shaft, wherein, in accordance with the invention, the paddles or vanes (8) are plastic paddles or vanes which have a surface which is ink-rejecting and which prevents deposition of the ink thereon.

2. The distributor of claim 1, wherein said paddles or vanes (8), in cross section, are rounded.

3. The distributor of claim 2, wherein said paddles or vanes (8), in cross section, are part-circular or part-spherical.

4. The distributor of claim 3, wherein the relationship of width (B) to thickness (D) of said paddles or vanes (8) is between about 3:1 and 4:1.

5. The distributor of claim 4, wherein said paddles or vanes (8) essentially consist of polyamide reinforced with carbon fiber reinforcement.

6. The distributor of claim 1, wherein said paddles or vanes (8) are polyamide reinforced with carbon fiber reinforcement paddles or vanes.

7. The distributor of claim 6, wherein the polyamide comprises polyamide 6.6, and the relationship, by weight, is about 70% polyamide to 30% carbon fibers.

8. The distributor of claim 6, wherein said paddles or vanes (8), in cross section, are rounded.

9. The distributor of claim 6, wherein said paddles or vanes are injection-molded articles.

10. The distributor of claim 1, wherein said paddles or vanes (8) consist entirely of plastic material.

11. The distributor of claim 10, wherein said paddles or vanes are injection-molded articles.

12. The distributor of claim 1, wherein the paddle wheel structure includes a plurality of axially staggered and spaced rings (4) of said paddles or vanes (8) secured to said shaft;

wherein a plurality of braking tongues (9) are provided, located in the spaces or gaps between adjacent rings of said paddles or vanes; and wherein said braking tongues (9) are plastic braking tongues having a surface which is ink-rejecting and prevents deposition of ink thereon, said braking tongues, in cross section, having a rounded shape and being positioned, in a plane perpendicular to said printed products, which plane is slightly offset with respect to said paddles or vanes (8) to deform the printed products into a gentle or shallow undulating wave.

13. The distributor of claim 12, wherein said braking tongues (9) comprise a plastic material which is essentially identical to the material of said paddles or vanes (8), and having essentially similar cross section and dimension as said paddles or vanes.

14. The distributor of claim 1, wherein said paddles or vanes (8) consist of fiber or filamentary material reinforced plastic.

15. The distribution of claim 1, wherein said paddles or vanes (8), in cross section, have a part-circular or part-spherical profile.

* * * * *